United States Patent [19]

Hukkanen et al.

[11] Patent Number: 4,903,520

[45] Date of Patent: Feb. 27, 1990

[54] METHOD FOR STRAIGHTENING CAST ANODES

[75] Inventors: Rauno K. Hukkanen, Nummela; Olli E. Ylimäki, Espoo; Seppo I. Kuisma, Helsinki, all of Finland

[73] Assignee: Outokumpu Oy, Espoo, Finland

[21] Appl. No.: 179,574

[22] Filed: Apr. 7, 1988

[30] Foreign Application Priority Data

Apr. 16, 1987 [FI] Finland ..... 871709

[51] Int. Cl.[4] ..... B21D 3/16

[52] U.S. Cl. ..... 72/309; 72/381; 72/412; 72/470; 72/472; 204/289; 29/623.1; 29/874

[58] Field of Search ..... 204/281, 288, 289; 29/623.1, 825, 882, 874, 747; 72/412, 422, 420, 379, 470, 472, 381, 389, 308, 309

[56] References Cited

U.S. PATENT DOCUMENTS

| | | | |
|---|---|---|---|
| 3,096,808 | 7/1963 | Holsteyn | 72/373 |
| 3,696,656 | 10/1972 | Nara et al. | 72/420 |
| 4,263,120 | 4/1981 | Berndt et al. | 204/288 |
| 4,513,499 | 4/1985 | Rolden | 29/874 |
| 4,638,559 | 1/1987 | McGonigel | 29/882 |
| 4,641,514 | 2/1987 | Rozmus | 29/882 |

OTHER PUBLICATIONS

"Electrometallurgy", Thomas Henrie and Don Baker, 12/1968, pp. 344–348.

"A Concise Encyclopaedia of Metallurgy", A. D. Merriman, 1965, p. 277.

*Primary Examiner*—David Jones

*Attorney, Agent, or Firm*—McAulay, Fisher, Nissen & Goldberg

[57] ABSTRACT

Method and apparatus for straightening of cast anodes on their way to a stage for electrolytic refining of metals. The straightening of the anodes and the elimination of casting fins is carried out by pressing the anode at several spots or spot areas simultaneously.

11 Claims, 1 Drawing Sheet

METHOD FOR STRAIGHTENING CAST ANODES

Figure 1:
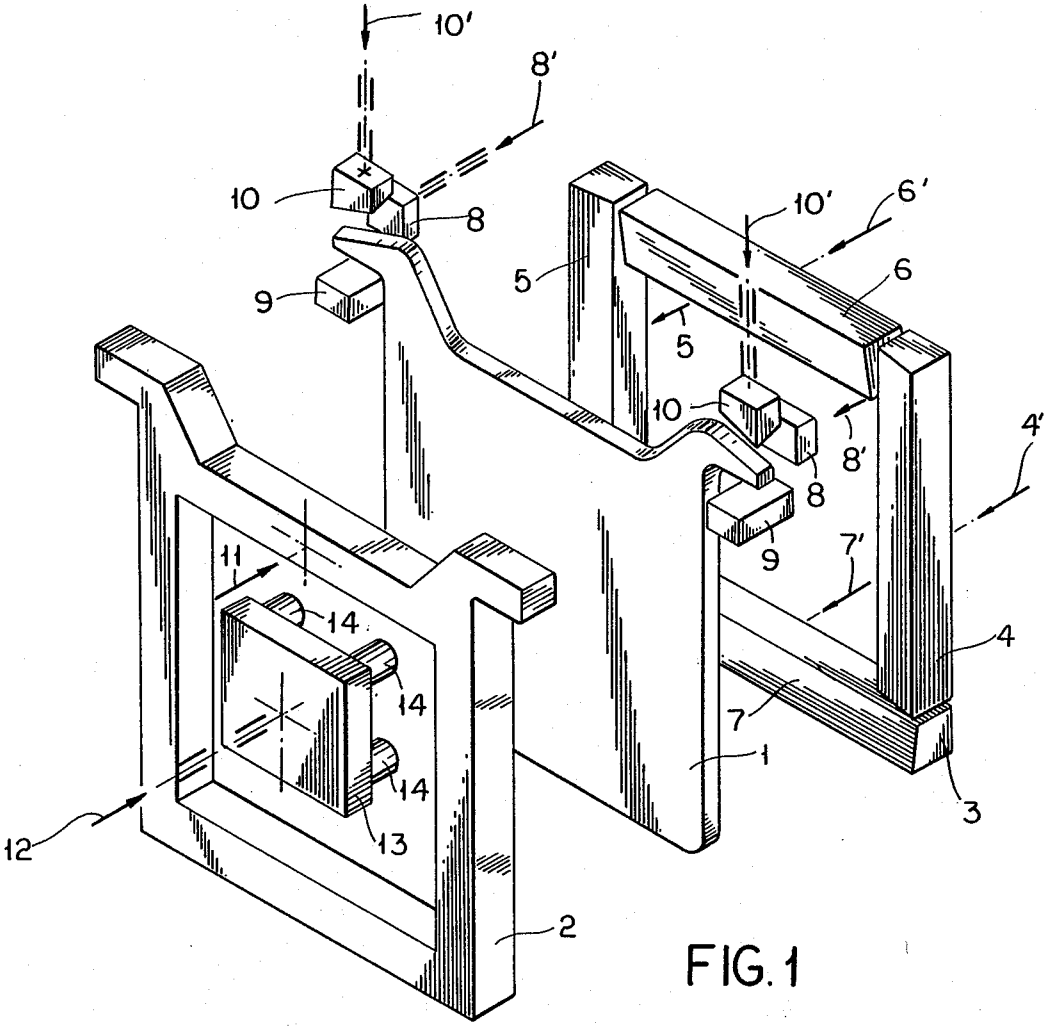

The invention relates to a method for straightening cast anodes on their way to the electrolytic refining of metals, as well as to an apparatus for realizing the method. An essential feature of the method is that the straightening of anodes and the elimination of casting fins is carried out by pressing the anode at several different spots simultaneously.

The final refining of several metals is carried out by means of electrolysis. The refining process employs soluble anodes which are obtained by casting molten metal into anode moulds. It is natural that casting fins are created at the anode edges, as well as on the spot where the lifting pins hit when rising from the mould bottom. In cases where an anode mould is used for a long time, there is often created a recess on the bottom of the mould, which causes a respective swell to form on one side of the anode. The lifting of an anode onto the conveyor may result in torsions in the lug parts, so that the anode, when lowered into the electrolytic cell, may cause short circuits and weakening of the current efficiency. The bearing surface of an anode lug is often concave, in which case the contact of the busbar remains weak.

A number of devices for straightening anodes and eliminating casting flaws have been developed in order to amend the above described anode defects and inadequacies. Anode straightening devices are illustrated for instance in the U.S. Pat. No. 3,096,808 to Holsteyn and U.S. Pat. No. 3,696,656 to Nara et al. In both arrangements, the anode is pressed in between two rigid plates, so that an extremely strong force is required for compressing the malformations in the anode and for flattening the swell created in the middle. In practice these methods have not resulted in the elimination of casting fins and in levelling off the swell, because in swollen anodes, the pressing force is directed towards the center of the anode only, and it has not been possible to achieve sufficient power for flattening the material.

According to another method, removal of the casting fins of anodes has been attempted by cutting them away. Among the drawbacks of this method let us point out that it is slow, that it produces chips, and that in any case the swell in the middle remains unchanged.

We have now developed a new method where the straightening of anodes and the removal of casting fins is not carried out by pressing the anode in between two rigid, uniform plates, but the casting fins in the edge areas and near the lifting pin are evened out by pressing the anode only at the edge areas between several independent pressing members. The anode lugs are likewise straightened in the vertical and horizontal directions by means of their own independent presses. According to the method, the swell in the anode is measured electrically in connection with the straightening, whereafter the swell is levelled off to both sides of the anode by yet another independent press. The compression focused on different spots takes place simultaneously. The method and the apparatus are described in more detail in the independent claims of this application.

The apparatus of the invention is described in more detail in the appended drawing of FIG. 1 which illustrates the principle of operation of the apparatus.

The anode 1 can be brought to the straightening and levelling press supported either by the lugs or at the bottom. Irrespective of the fashion of insertion, the anode 1 is placed in between the stopping member 2 and the pressing member 3 of the press. The stopping member 2 is a uniform piece with the same configuration as the anode, but it is open in the middle. The stopping member can be either stationary or movable depending on the fashion how the anode is brought into the press. The pressing member 3 is formed of several parts so that it contains separate vertical bars 4 and 5 as well as horizontal bars 6 and 7.

When an anode is inserted in between the stopping member 2 and the pressing member 3, these are pressed against each other so that each bar of the pressing member is provided with a respective hydraulic cylinder 4', 5', 6' and 7', indicated by arrows, which hydraulic cylinders straighten the anode and level the casting fins off to the anode surface. Although each bar has its own cylinder, these do not, however, move with respect to each other but simultaneously. The separate hydraulic cylinders can still belong to the same hydraulic circuit. The fact that each edge can be pressed separately has proved to be particularly useful, because for example if there are unusually thick fins at one edge, a uniform press would press only this edge and leave the other edges untouched; whereas with separate press bars, in the above case three edges can be evened out by compression, and only one edge remains uneven.

The straightening of the anode lugs is carried out simultaneously with the elimination of the edge fins and the levelling procedure. If the anode is supported by the lugs, the straightening is at this stage performed only on the horizontal level. The horizontal pressing members 8 of the lugs press the lug against the stopping member 2 by means of their respective hydraulic cylinders 8'. The drawing also illustrates the straightening of the lugs in the vertical direction, in which case underneath the lugs there are placed the stopping members 9, and the pressing members 10 are pressed against them by means of the actuating cylinders 10'. As was pointed out above, the straightening of the lugs is a very important stage in the straightening of the whole anode, because the bearing surface (the underneath surface) of the lugs must get as good a contact with a busbar as possible. If the bearing surface is slanted, the whole anode remains in a slanted position, which weakens the current efficiency and may cause short circuits.

If the anodes are inserted into the press supported by their lugs, the lugs are straightened after removal from the press in the vertical direction in the same fashion as was described above.

The anode is placed in the press so that the "rear side" which was earlier pressed against the mould bottom, falls now against the stopping member 2. Thus the fins created in the top part of the anode by the lifting pins remain on the side of the stopping member 2, and they are removed and levelled off to the side of the stopping member, by means of the actuating cylinder 11 directed horizontally towards the top part of the stopping member, simultaneously with the straightening of the rest of the anode.

The swell existing in the anode is measured in connection with the straightening of the anode by means of measuring electronics connected to the central cylinder 12. On the basis of this measurement, the anode is pressed on the side of the stopping member by means of the swell stop 13 and the central cylinder 12 pushing this swell stop so that half of the thickness of the swell is levelled off to the other side of the anode. In order to level the swell off as evenly as possible, the swell stop 13 is provided with several pins 14, advantageously 2–4 pins, which are directed towards the area of the swell.

According to the above specification, an anode can be straightened and the casting fins evened out by performing several simultaneous pressing operations originating from different directions and carried out by different cylinders. The above description speaks of hydraulic cylinders, but it is naturally clear that if necessary, the actuating cylinders can be for instance pneumatic cylinders. It is either possible to subject all nodes to the straightening procedure, or to arrange for instance a weighing prior to the straightening, so that those anodes which are classified as rejected according to their weight (too large a deviation as compared to the normal anode weight) are removed already before straightening, or else left unstraightened.

As is seen in FIG. 1, the anode is straightened in the vertical direction. This is advantageous, because thus the anode is more easily straightened also as regards the lugs, and thus the bearing surface of the lugs is rendered as straight as possible. This is not always achieved with horizontal straightening.

We claim:

1. A method for straightening an anode provided with lugs and for eliminating casting fins thereon which anode is on its way to an apparatus for electrolytic refining of metals, comprising the steps of:

placing an anode in a vertical position;

providing a vertically oriented uniform stopping member which corresponds to the anode in configuration and has an opening in the middle thereof;

providing a vertical oriented pressing means formed of several independent pressing members and placing said vertically oriented pressing means in opposition to the vertically oriented uniform stopping member;

positioning said vertically oriented uniform stopping member and said vertically oriented pressing means in a vertical position;

compressing the anode at several spot areas between the vertically oriented uniform stopping member and said independent pressing members of said vertically oriented pressing means for evening out the anode by simultaneously directing the compression at the several spot areas;

directing a separate compression towards each edge of the lugs; and providing at least one actuating cylinder for each said independent pressing member.

2. The method of claim 1 forming the independent pressing members of said pressing means from separate vertical and horizontal bars.

3. The method of claim 2, providing each of said separate bars of said pressing means with a respective one of said actuating cylinders and pressing the bars simultaneously.

4. The method of claim 1, providing said separate compression to said lugs by a horizontally oriented pressing member for each of said lugs, for straightening thereof, and providing at least one actuating cylinder for each of said horizontally oriented pressing members.

5. The method of claim 1, including providing a horizontally oriented stopping member for each of the lugs for straightening the lugs on the vertical level, and providing a vertically oriented pressing member for each of the lugs and cooperating with said horizontally oriented stopping members, and at least one actuating cylinder for each of said vertically oriented pressing members to straighten each of the lugs on a vertical level.

6. The method of claim 4, including providing a horizontally oriented stopping member for each of the lugs for straightening the lugs on the vertical level, and providing a vertically oriented pressing member for each of the lugs and cooperating with said horizontally oriented stopping members, and at least one of said actuating cylinders for each of said vertically oriented pressing members to straighten each of the lugs on a vertical level.

7. The method of claim 1, including providing a swell stop located in the opening of said vertically oriented uniform stopping member and electronic measuring means located on said swell stop for measuring swell, and using at least one actuating cylinder as a central cylinder for pressing the swell stop for levelling off a swell.

8. The method of claim 1, placing one of the actuating cylinders in a horizontal top part of the vertically oriented uniform stopping member.

9. The method of claim 1, wherein the actuating means includes a hydraulic cylinder for each of the bars, and moving the cylinders simultaneously.

10. The method of claim 1, providing a swell stop having several pins in a central part of the vertically oriented uniform stopping member, and using at least one actvating cylinder as a central cylinder for the swell stop directed towards the anode.

11. The method of claim 1, including levelling off a swell by providing a swell stop with several pins in a center part of the vertically oriented uniform stopping member, and using at least one actuating cylinder as a separate central cylinder for directing the swell stop towards the anode.

* * * * *